US006699054B1

(12) United States Patent
Critelli

(10) Patent No.: US 6,699,054 B1
(45) Date of Patent: Mar. 2, 2004

(54) FLOAT MOUNT COAXIAL CONNECTOR

(75) Inventor: David J. Critelli, Southbury, CT (US)

(73) Assignee: Applied Engineering Products, Inc., New Haven, CT (US)

( * ) Notice: Subject to any disclaimer, the term of this patent is extended or adjusted under 35 U.S.C. 154(b) by 0 days.

(21) Appl. No.: 10/345,445

(22) Filed: Jan. 15, 2003

(51) Int. Cl.[7] ..... H01R 13/64; H01R 12/00
(52) U.S. Cl. ..... 439/248; 439/63
(58) Field of Search ..... 439/63, 248, 581, 439/578

(56) References Cited

U.S. PATENT DOCUMENTS

| | | | | | |
|---|---|---|---|---|---|
| 4,358,174 | A | | 11/1982 | Dreyer | 439/249 |
| 4,734,046 | A | | 3/1988 | McAllister et al. | 439/63 |
| 5,304,969 | A | * | 4/1994 | Jacobowitz | 439/63 |
| 5,322,453 | A | | 6/1994 | Resnick et al. | 439/581 |
| 5,329,262 | A | | 7/1994 | Fisher, Jr. | 439/248 |
| 5,516,303 | A | * | 5/1996 | Yohn et al. | 439/248 |
| 5,662,480 | A | | 9/1997 | Togashi | 439/63 |
| 5,769,652 | A | | 6/1998 | Wider | 439/248 |
| 5,775,927 | A | | 7/1998 | Wider | 439/188 |
| 5,795,162 | A | | 8/1998 | Lambert | 439/63 |
| 5,842,873 | A | | 12/1998 | Gonzales | 439/63 |
| 5,980,290 | A | | 11/1999 | Meynier et al. | 439/246 |
| 6,109,964 | A | * | 8/2000 | Kooiman | 439/583 |
| 6,146,168 | A | | 11/2000 | Ishii | 439/63 |
| 6,224,390 | B1 | | 5/2001 | Mitani et al. | 439/63 |
| 6,224,407 | B1 | * | 5/2001 | Duquerroy et al. | 439/188 |
| 6,354,855 | B2 | | 3/2002 | Annequin | 439/248 |
| 6,409,519 | B1 | | 6/2002 | Bacon | 439/63 |

* cited by examiner

*Primary Examiner*—Gary Paumen
*Assistant Examiner*—Briggitte R. Hammond
(74) *Attorney, Agent, or Firm*—Anthony J. Casella; Gerald E. Hespos

(57) ABSTRACT

A coaxial connector includes inner and outer contact assemblies. The outer contact assembly includes a base securely mounted to a circuit board and a floating outer contact that can move both axially and radially relative to the base. The inner contact assembly includes a plunger connected to a signal carrying circuit element on the circuit board in a manner that permits transverse float. The inner contact assembly further includes a receptacle that can slide axially relative to the plunger. Annular insulators are disposed between the inner and outer contact assemblies. Additionally, resilient O-rings are provided between the inner and outer contact assemblies for urging the receptacle of the inner contact assembly in a mating direction relative to the plunger.

9 Claims, 4 Drawing Sheets

FLOAT MOUNT COAXIAL CONNECTOR

BACKGROUND OF THE INVENTION

1. Field of the Invention

The invention relates to a low profile surface mount coaxial connector that permits both axial and radial float relative to a mating connector.

2. Description of the Related Art

A coaxial cable includes an inner conductor and an outer conductor that surrounds the inner conductor. Insulating or dielectric material typically is disposed between the inner and outer conductors to maintain the substantially concentric relationship therebetween. The inner conductor is used for carrying a signal, and the outer conductor functions as a shield. Thus, the signal carried by the inner conductor will not affect nearby electronic equipment, and conversely nearby electronic equipment will not adversely affect the signal carried by the inner conductor.

A coaxial connector may be mounted to an end of a coaxial cable so that the conductors of the cable can be connected to another coaxial cable, to an apparatus or to a circuit board. The coaxial connector includes a center contact that is connected to the inner conductor of the cable and an outer contact that is connected to the outer conductor of the cable. An insulation or dielectric material may be disposed between the inner and outer contacts to maintain a substantially coaxial relationship. Coaxial connectors typically are provided as a male and female pair of connectors configured so that the inner and outer contacts of one connector in the pair telescope into electrical contact with the inner and outer contacts of the mating connector.

Connections often must be made between one or more coaxial connectors on one panel or circuit board and a corresponding number of coaxial connectors on another panel or circuit board. These connections typically are made by placing the panels or circuit boards in opposed relationship to one another so that the connectors on one panel or circuit board face the connectors on the opposed panel or circuit board. The panels and circuit boards then are moved toward one another so that the respective connectors mate. The ability to mate the opposed pairs of panel-mounted or board-mounted electrical connectors in this manner depends partly upon the precision of mounting the connectors on the panels or boards. Even small mounting errors can significantly complicate the connection and can significantly increase the forces required to achieve proper mating. Excessive force on either panel or board can damage the panel or board and the circuits thereon. Accordingly, some coaxial connectors are configured to float transversely and/or radially relative to the panel or circuit board to facilitate alignment for mating. Coaxial connectors that are configured to float relative to the panel or circuit board are shown in U.S. Pat. Nos. 4,358,174 and 5,769,652.

There have been substantial efforts in recent years to reduce the size of electrical and electronic components. The electronics industry also is very competitive and continually seeks ways to reduce costs. The above-described U.S. Pat. No. 4,358,174 and much of the other prior art achieves a panel-to-panel connection by providing separate mateable connectors on each panel and then urging the mateable connectors into connection with one another. Significant size and cost savings have been achieved in some electrical connection art areas by employing surface mounting (e.g., surface mounted IC chips). A surface mount connector enables a connector on one panel to be connected directly to conductive regions on a mating panel. The known surface mount technology is not well suited for coaxial connectors in view of the need to provide shielding across the connection. A few attempts have been made to mount a small coaxial receptacle to conductive regions on a board and then to mate a coaxial plug with the receptacle. Such a connection is shown in U.S. Pat. No. 5,662,480. The above-described alignment problems that exist for panel-to-panel connections of coaxial connectors also exist for surface mounted connections.

In view of the above, it is an object of the subject invention to provide a coaxial connector assembly that enables axial and/or radial float for achieving panel-to-panel coaxial connections.

It is also an object of the subject invention to provide a low profile coaxial connector that is well suited for panel-to-panel connections.

SUMMARY OF THE INVENTION

The subject invention relates to a coaxial connector for achieving connection between signal carrying circuits on first and second opposed circuit boards and for achieving a grounding connection and shielding between the first and second circuit boards. The first circuit board is provided with a plurality of conductive regions printed or otherwise disposed thereon. The conductive regions on the first circuit board include a first signal carrying region and a first ground that may substantially concentrically surround at least a portion of the signal carrying region. Similarly, the second circuit board may be provided with a plurality of conductive regions printed or otherwise disposed thereon. The conductive regions on the second circuit board may include a second signal carrying region and a second ground that may at least partly surround the signal carrying region. The signal carrying regions and the ground regions on the respective circuit boards are connected to other signal carrying circuit elements and ground circuit elements by techniques that are known to those skilled in this art.

The coaxial connector may be used with a short cylindrical electrically conductive guide sleeve that has a mounting end, a mating end and an inner circumferential surface extending between the ends. The mounting end of the guide sleeve is secured to the first circuit board and is connected electrically to the first ground region on the first circuit board. Additionally, the guide sleeve is mounted substantially concentrically around the first signal carrying region on the first circuit board. The inner circumferential surface of the guide sleeve may be substantially cylindrical at locations adjacent the mounting end of the guide sleeve. However, the inner circumferential surface of the guide sleeve may be chamfered to define an outward taper adjacent the mating end.

The coaxial connector includes an outer contact assembly with a generally tubular base. The base has a mounting end, a mating end and an inner circumferential surface extending between the ends. The mounting end of the base is fixed to the second circuit board and is connected electrically to the second ground. The mating end of the base may be characterized by an inwardly extending flange with an inside diameter less than the inside diameter of the inner circumferential surface of the base at locations spaced from the flange.

The outer contact assembly further includes a floating outer contact with a mounting end, a mating end and inner and outer circumferential surfaces extending between the ends. The floating outer contact preferably includes an outwardly extending flange at the mounting end. The outwardly extending flange of the floating outer contact is disposed between the second circuit board and the flange at the mating end of the base of the outer contact assembly. The flange at the mounting end of the floating outer contact defines an outside diameter that is greater than the inside diameter of the flange at the mating end of the base of the outer contact assembly. However, the outer diameter of the flange at the mounting end of the floating outer contact is less than the inside diameter of the inner circumferential surface of the base at locations adjacent the flange. The outside diameter of the floating outer contact at locations adjacent the flange are less than the inside diameter of the flange at the mating end of the base. Thus, the floating outer contact can float both radially and axially relative to the base of the outer contact assembly, but cannot be separated from the base of the outer contact assembly.

The mating end of the floating outer contact may have an inwardly extending flange. However, portions of the inner circumferential surface of the floating outer contact between the inwardly extending flange and the mating end preferably are substantially continuously cylindrical. The outer circumferential surface of the floating outer contact preferably is chamfered adjacent the mating end to facilitate alignment and to generate float during mating.

Portions of the floating outer contact between the mating end and the base of the outer contact assembly may include an outwardly extending bearing flange. The bearing flange defines an outside diameter that exceeds the inside diameter of the inwardly extending flange on the base of the outer contact assembly.

The outer contact assembly further may include also a spring between the inwardly extending flange of the base and the outwardly extending flange at the mounting end of the floating outer contact. The spring may be configured to urge the floating outer contact towards the second circuit board. The outer contact assembly may further include a spring between the bearing flange of the floating outer contact and the inwardly extending flange of the base of the outer contact assembly. The spring washer biases the floating outer contact away from the second circuit board.

The coaxial connector further includes an inner contact assembly that is disposed substantially concentrically within the outer contact assembly and that extends from the second circuit board substantially to the mating end of the floating outer contact. The inner contact assembly includes a plunger and a receptacle that are capable of axially floating relative to one another while achieving a sliding electrical contact therebetween. In a preferred embodiment, the plunger extends from the second circuit board, and the receptacle extends from the plunger to the mating end of the floating outer contact. At least one of the plunger and the receptacle may be configured to achieve radial float therein. Additionally, the inner contact assembly may be configured to achieve radial float relative to the second signal carrying circuit element on the second circuit board.

The coaxial connector further includes a plurality of non-conductive elements between the inner and outer contact assemblies. The non-conductive elements function to substantially center at least portions of the inner contact assembly relative to at least portions of the outer contact assembly. The non-conductive elements between the inner and outer contact assemblies preferably include at least one resilient O-ring, and preferably a stacked array of resilient O-rings. The number of O-rings and the combined axial dimensions of the O-rings are selected to bias the plunger and receptacle of the inner contact assembly into an extended position and toward the first circuit board. However, the O-rings can be compressed resiliently in response to forces generated during mating.

The coaxial connector is employed merely by positioning the first and second circuit boards in substantially juxtaposed relationship to one another and then urging the first and second circuit boards toward one another. The chamfer on the outer surface at the mating end of the floating outer contact will engage the chamfered entry to the guide sleeve on the first circuit board. The engagement of these chamfers will help to guide the first and second circuit boards into proper alignment with one another and will generate radial float of the floating outer contact to permit the floating outer contact to telescope into the guide sleeve. The outside diameter of the floating outer contact is significantly less than the inside diameter of the guide sleeve. Hence, there are minimal connecting forces created during mating. Movement of the first and second circuit boards toward one another will urge the mating end of the floating outer contact into engagement with the first ground circuit printed or otherwise disposed on the first circuit board. Substantially simultaneously, the mating end of the inner contact assembly will contact the first signal carrying circuit element on the first circuit board.

The receptacle and plunger of the inner contact assembly may telescope relative to one another in response to axial forces generated as the first and second circuit boards are moved into their final position. In all such positions, the resilient O-rings will exert biasing forces that urge the mating end of the inner contact assembly against the signal carrying circuit element on the first circuit board. The resilient force exerted by the inner contact assembly can be varied by providing more or fewer resilient O-rings, and replacing any such O-rings that are removed by non-resilient spacers. Thus, greater axial float can be achieved with a larger number of resilient O-rings.

Plural coaxial connector assemblies are likely to be used simultaneously at different locations on the first and second circuit boards. The radial and axial float of the floating contact members may vary from one coaxial connector assembly to another.

DETAILED DESCRIPTION OF THE PREFERRED EMBODIMENTS

Figure 1:
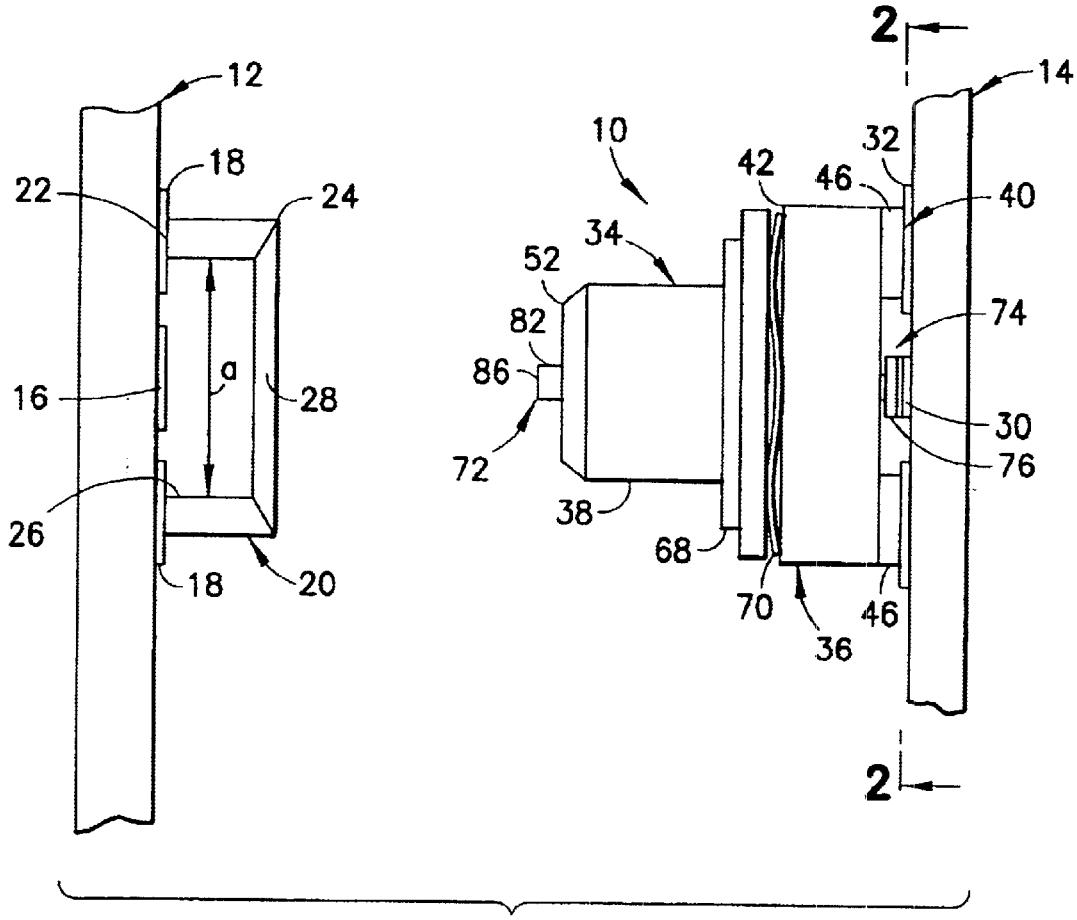
FIG. 1 is a side elevational view of a coaxial connector assembly according to a first embodiment of the invention.
Figure 2:
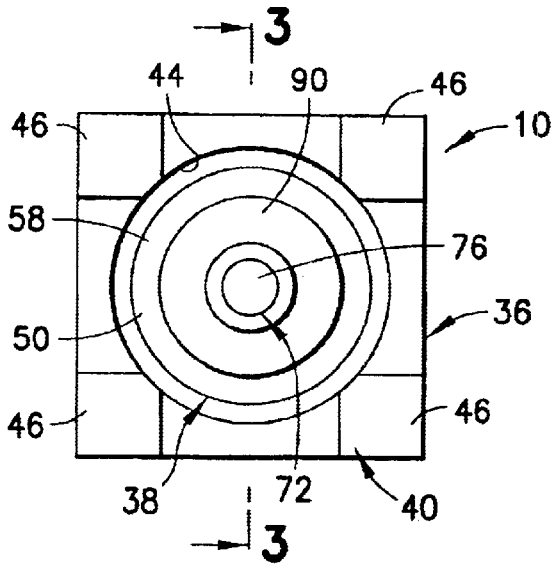
FIG. 2 is a cross-sectional view taken along line 2—2 in FIG. 1.
Figure 3:
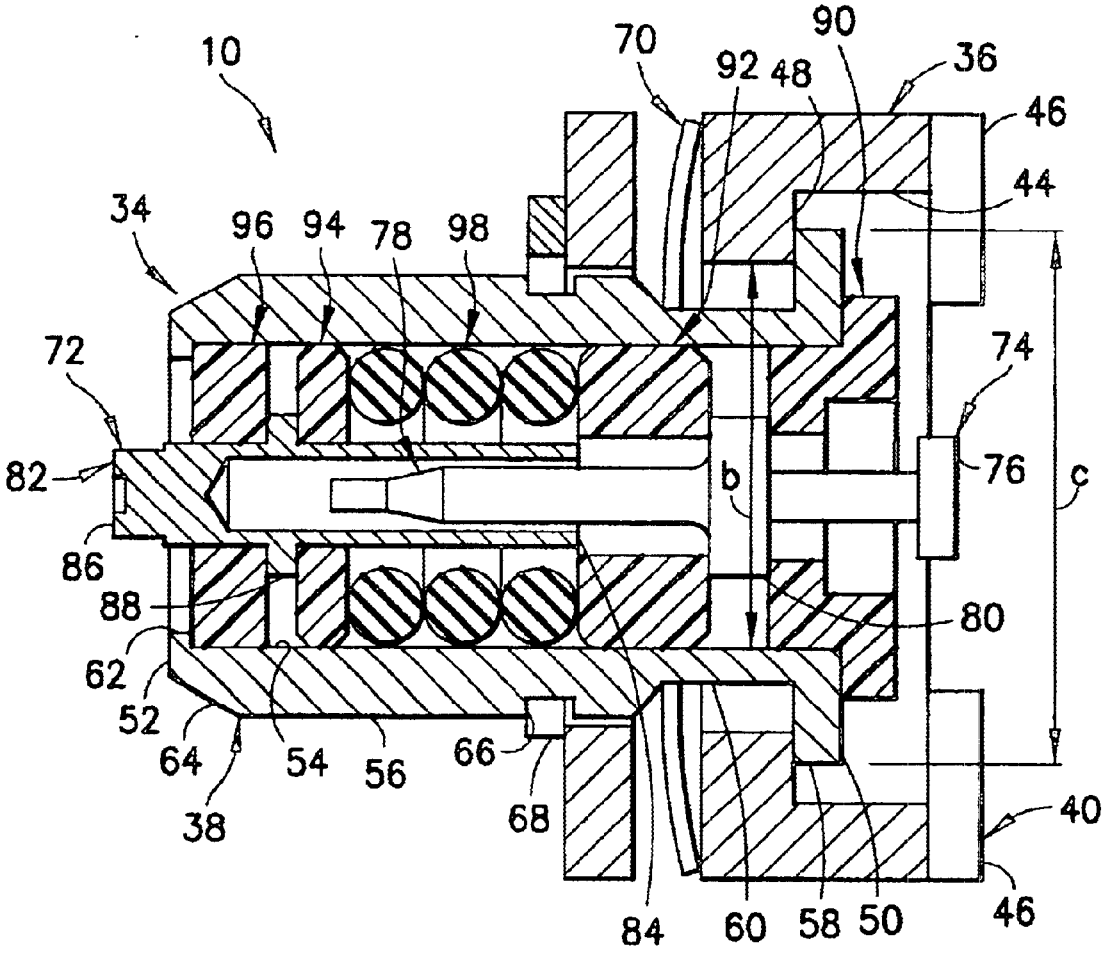
FIG. 3 is a cross-sectional view taken along line 3—3 in FIG. 2.

A coaxial connector in accordance with the subject invention is identified generally by the numeral 10 in FIGS. 1–3. The coaxial connector 10 is employed to connect circuit elements printed or otherwise disposed on a first circuit board 12 to corresponding circuit elements printed or otherwise disposed on a second circuit board 14. More particularly, the first circuit board 12 is provided with a first signal carrying circuit element 16 and a first ground circuit elements 18 spaced from the first signal carrying circuit element 16. The circuit elements 16 and 18 can take many different forms that known to those skilled in this art. As depicted herein, the first signal carrying circuit element 16 is a printed region on a surface of the first circuit board 12, and the first ground circuit elements 18 represent four lands disposed on the circuit board. In other embodiments, the first ground circuit 18 may define a generally annular region surrounding the first signal carrying circuit element 16. In still other embodiments, virtually all of the surface of the first circuit board 12 may be coated or laminated with a ground element, but the ground element may be removed or not applied to regions surrounding the signal carrying circuit element 16. The first circuit board 12 is further provided with a short cylindrical guide sleeve 20 having a mounting end 22, a mating end 24 and an inner circumferential surface 26 extending between the ends. Portions of the inner circumferential surface 26 adjacent the mounting end 22 define an inside diameter "a". However, portions of the inner circumferential surface adjacent the mating end 24 define a chamfer 28 that flares outwardly for guiding the coaxial connector 10 into a mated position with the circuit elements on the first circuit board, as explained herein. The mounting end 22 is soldered or otherwise securely connected both mechanically and electrically to the first ground circuit elements 18 on the first circuit board 12.

The second circuit board 14 similarly is provided with a second signal carrying circuit element 30 and second ground circuit elements 32. The circuit elements 30 and 32 may be applied to the second circuit board 14 by any of the techniques described above with respect to the first circuit board 12 or by other technologies known to those skilled in this art.

The coaxial connector 10 includes an outer contact assembly 34 with a base 36 and a floating outer contact 38 that preferably are formed from brass or other alloy with appropriate mechanical and conductivity characteristics. The base 36 includes a mounting end 40, a mating end 42 and a passage 44 extending continuously between the ends 40 and 42. The mounting end 40 is characterized by lands 46 disposed symmetrically relative to one another substantially at the corners of a square. The lands 46 may be soldered or otherwise connected mechanically and electrically to the second ground elements 32 on the surface of the second surface board 14. The mating end 42 of the base 36 is characterized by an inwardly extending flange 48. Portions of the inner circumferential surface 44 of the base 36 at the flange 48 are cylindrically generated and define an inside diameter "b".

The floating outer contact 38 of the outer contact assembly 34 includes a mounting end 50, a mating end 52 and inner and outer circumferential surfaces 54 and 56. A flange 58 extends outwardly from the outer circumferential surface 56 at locations adjacent the mounting end 50 of the floating outer contact 38. The flange 58 defines an outside diameter "c" that exceeds the inside diameter "b" of the inwardly extending flange 48 on the base 36. Portions of the floating outer contact 38 adjacent the flange 58 define a reduced diameter region 60 with an outside diameter that is significantly less than the inside diameter "b" defined by the inwardly extending flange 48 on the base 36. The floating outer contact 38 is assembled with the base 36 so that the flange 58 of the floating outer contact 38 is trapped between the flange 48 of the base 36 and the second circuit board 14. However, the axial dimension of the flange 58 of the floating outer contact 38 is selected relative to the dimensions of the base 36 to permit axial float of the floating outer contact 38 in directions to or away from the flange 48 and the second circuit board 14. Additionally, the relative outside diameter of the reduced diameter portion 60 of the floating outer contact 38 and the inside diameter "b" of the flange 48 of the base 36 enable radial float of the floating outer contact 38 relative to the base 36.

The mating end 52 of the floating outer contact 38 is characterized by an inwardly extending flange 62. Portions of the inner circumferential surface 54 of the floating outer contact 38 adjacent the flange 62 are substantially uniformly cylindrical entirely to the mounting end 50 of the floating outer contact 38. The outer circumferential surface 56 of the floating outer contact 38 defines a chamfer 64 at the mating end 52. The chamfer 64 facilitates the guiding of the floating outer contact 38 into the guide sleeve 20 and will help to generate radial float. The outer circumferential surface 56 of the floating outer contact 38 is further characterized by an annular groove 66 at a location between the chamfer 64 and the reduced diameter portion 60. A lock washer 68 is locked into engagement with the lock groove 66 and defines an outside cross-sectional dimension greater than the inside diameter "b" of the inwardly extending flange 48 at the mating end 42 of the base 36. The lock washer 68 traps a flat washer 69 between the lock washer 68 and the base 36.

The outer contact assembly 34 further includes a spring washer 70 between the lock washer 68 and the mating end 42 of the base 36. The spring washer 70 may be formed from a stainless steel and exerts axial forces on the lock washer 68 for urging the floating outer contact 38 away from the second circuit board 14. In certain embodiments, an annular spring may be disposed between the flange 48 of the base 36 and the flange 58 of the floating outer contact 38 for countering the biasing forces exerted by the spring washer 70 and substantially balancing the axial forces on the floating outer contact 38. The annular spring between the flange 48 of the base 36 and the flange 58 of the floating center contact 38 also contributes to RF shielding and prevents the creation of gaps that could lead to signal leakage in certain relative axial positions of the spring biased assemblies.

The coaxial connector 10 further includes an inner contact assembly 72 that may be formed from the same material as the outer contact assembly 34. However, contact regions of the inner contact assembly 72 preferably are gold plated. The inner contact assembly 72 includes a plunger 74 with a mounting end 76 and a mating end 78. The mounting end 76 defines a substantially flat land for contacting the second signal carrying circuit element 30 on the second circuit board 14. A flange 80 projects outwardly on the plunger 74 at locations between the mounting and mating ends 76 and 78. The inner contact assembly 72 further includes a receptacle 82 having a receptacle end 84 and a mating end 86. The receptacle end 84 is substantially hollow and dimensioned to slidably receive the mating end 78 of the plunger 74. The mating end 86 of the receptacle 84 is substantially planar and is dimensioned to engage the first signal carrying circuit 16 on the first circuit board 12. A flange 88 projects outwardly on the receptacle 82 at a location between the receptacle end 84 and the mating end 86.

The coaxial connector 10 further includes a plurality of substantially annular insulators. More particularly, a first annular insulator 90 surrounds portions of the plunger 74 between the flange 80 and the mounting end 76. The first insulator 90 engages the flange 80 of the plunger 74 and the mounting end 50 of the floating outer contact 38. A second annular insulator 92 surround portions of the plunger 74 between the flange 80 and the receptacle 72. A third annular insulator 94 surrounds the receptacle 72 between the flange 88 thereof and the receptacle end 84. A fourth annular insulator 96 surrounds the receptacle 82 and extends between the flange 88 and the flange 62 of the floating outer contact 38. The annular insulators 90–96 are substantially rigid. However, the coaxial connector 10 further includes a plurality of resilient O-rings 98 surrounding the inner contact assembly 72 and disposed between the annular insulators 92 and 94. The resilient O-rings 98 urge the receptacle 82 of the inner contact assembly 72 in a mating direction MD relative to the plunger 74. However, the resilient O-rings 98 permit the receptacle 72 to be collapsed axially over the plunger. Thus, the resilient O-rings 98 perform a function similar to the spring washer 70 of the outer contact assembly 34. More particularly, the spring washer 70 urges the floating outer contact 38 in the mating direction MD relative to the base 36, while the resilient O-rings 98 urge the receptacle 82 of the inner contact assembly 72 in the mating direction MD relative to the plunger 74 of the inner contact assembly 72.

The coaxial connector 10 is employed by soldering or otherwise connecting the lands 46 at the mounting end 40 of the base 36 to the ground elements 32 on the second circuit board 14. This fixed connection of the lands 46 to the ground elements 32 positions the mating end 76 of the plunger 74 adjacent the signal carrying circuit element 30 of the second circuit board 14. However, this mounting end 76 of the plunger 74 is not soldered to the signal carrying circuit element 30, and the plunger 70 is permitted to float both radially and axially. The first and second circuit boards 12 and 14 then are positioned in juxtaposed relationship to one another and are urged toward one another. This movement causes the mating end 52 of the floating outer contact 38 to move within the mating end 24 of the guide sleeve 20. Any misalignment between the coaxial connector 10 and the guide sleeve 20 will be corrected by the chamfer 64 at the mating end 52 of the floating outer contact 38 and the corresponding chamfer 28 of the guide sleeve 20. Thus, these cooperating chamfers 64 and 28 will cause the floating outer contact 38 and the receptacle 82 of the inner contact assembly 72 to float radially. Sufficient movement of the circuit boards 12 and 14 toward one another will bring the mating end 52 of the floating outer contact 38 into engagement with the ground elements 18 on the first circuit board 12 and substantially simultaneously will bring the mating end 86 of the receptacle 82 of the inner contact assembly 72 into contact with the signal carrying circuit element 16 of the first circuit board 12. Movement of the first and second circuit boards 12 and 14 into their final disposition will cause the floating outer contact 38 to displace toward the second circuit board 14 and against the biasing forces exerted by the spring washer 70. Similarly, the receptacle 82 will be biased over and further toward the plunger 74 and against the biasing forces exerted by the resilient O-rings 98. Thus, the ends 76 and 86 of the inner contact assembly 72 are biased between the circuit boards 12 and 14 to achieve a high quality connection between the signal carrying circuit elements 16 and 30.

Figure 4:
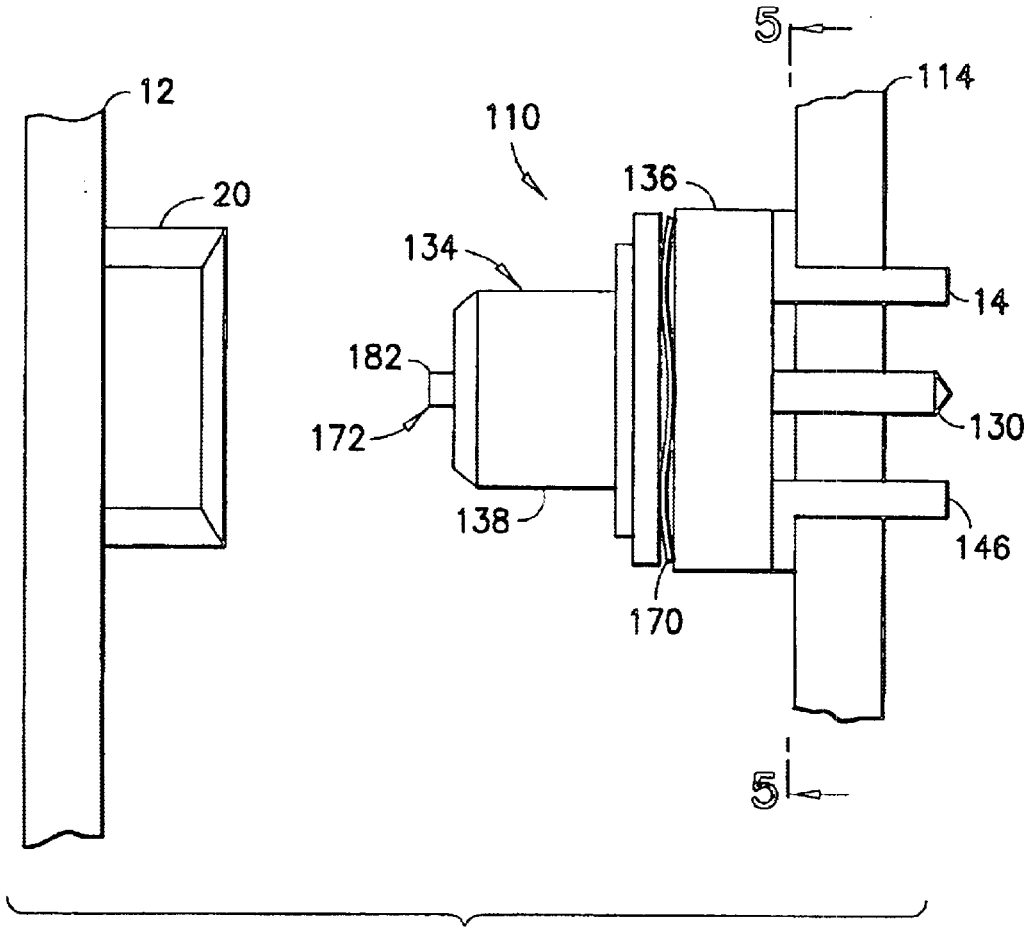
FIG. 4 is a side elevational view of a coaxial connector assembly according to a second embodiment of the invention.
Figure 5:
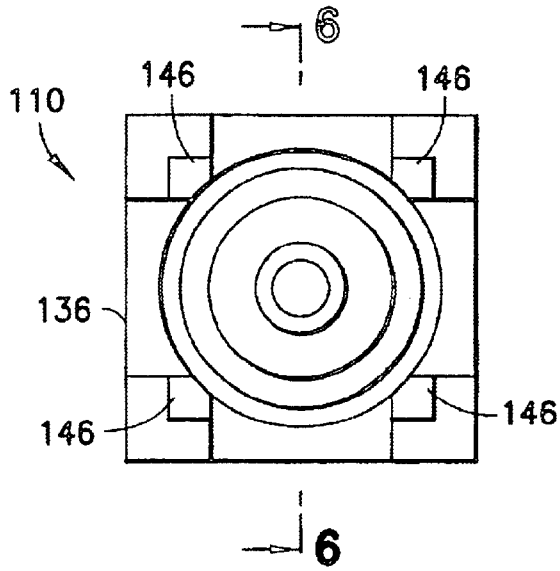
FIG. 5 is a cross-sectional view taken along line 5—5 in FIG. 4.
Figure 6:
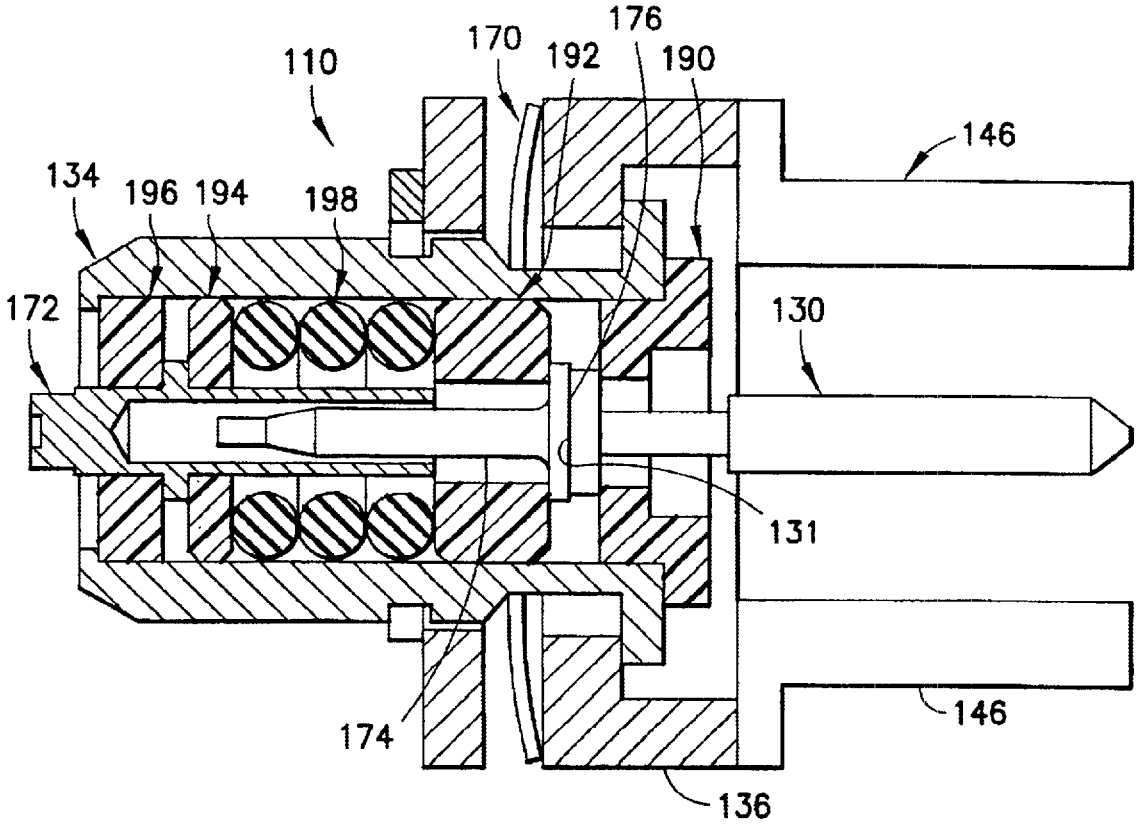
FIG. 6 is a cross-sectional view taken along line 6—6 in FIG. 5

The coaxial connector 10 described and illustrated above is intended for surface mount on the second circuit board 14. FIGS. 4–6 show a very similar coaxial connector 110 that is intended for soldered mounting to through holes formed in a second circuit board 114. The coaxial connector 110 include an outer contact assembly 134 with a base 136 and a floating outer contact 138. The floating outer contact 138 is substantially identical to the floating outer contact 38 described and illustrated above. Hence, further description of the floating outer contact 138 is not provided. The base 136 of the inner contact assembly 134 is structurally and functionally very similar to the base 36 described and illustrated above. However, the base 136 does not include the lands 46. Rather, the base 136 includes projections 146 that extend through holes (not shown) in the second circuit board 114. Thus, as with the previous embodiment, the base 136 of the outer contact assembly 134 is fixed relative to the second circuit board 14 and achieves soldered electrical connection with the ground elements on the second circuit board. The floating outer contact 138 is permitted to move both axially and radially relative to the fixed base 136, and is biased in the mating direction MD by a spring washer 170.

The coaxial connector 110 further includes an inner contact assembly 172 with a receptacle 182 substantially identical to the receptacle 82 described and illustrated above. However, the second circuit board 114 is provided with a signal carrying pin 130 that projects through the second circuit board 114 and partly into the coaxial connector 110. The pin 130 includes a mating end 131 spaced from the second circuit board 114.

The inner contact assembly 172 includes a plunger 174 that has a mounting end 176 disposed in sliding contact with the mating end 131 of the pin 130. Thus, the plunger 174 of the inner contact assembly 172.can float radially relative to the pin 130.

The coaxial connector 110 further includes annular insulators 190–196 that are substantially identical to the corresponding annular insulators on the coaxial connector 10 described and illustrated above. Additionally, the coaxial connector 110 includes resilient O-rings 198 at substantially the same locations and for performing substantially the same functions as the resilient O-rings 98 described and illustrated above.

The two embodiments described and illustrated above each show three resilient O-rings 98, 198 incorporated into the coaxial connector 10, 110. However, more or fewer resilient O-rings 98, 198 can be provided in accordance with the amount of resiliency required and the range of axial float required. More or fewer resilient O-rings 98, 198 merely require changes in the dimensions of the annular insulators 92, 94, 192, 194. Additionally, the preceding embodiments illustrate only a single coaxial connector 10, 110, mounted to the second circuit board 14, 114. However, several such coaxial connectors 10, 110 are likely to be mounted to the second circuit board 14, 114. Manufacturing tolerances invariably lead to certain of the coaxial connectors 10, 110 being shifted slightly from their specified positions on the second circuit board 14, 114. However, the radial float permitted by the coaxial connector 10, 110 is generated by the guide sleeves 20 and enables effective electrical connection to be made with minimal mating forces.

While certain preferred embodiments have been described and illustrated, it is apparent that various changes can be made without departing from the scope of the invention as defined by the appended claims.

What is claimed is:

1. A coaxial connector assembly for connection between first and second substantially parallel circuit boards, said first circuit board having a first signal carrying circuit element disposed thereon and a first ground, said second circuit board having a second signal carrying circuit element thereon and a second ground, said assembly comprising:

a guide sleeve connected to said first ground and projecting from said first circuit board, said guide sleeve defining a selected inside diameter;

an outer contact assembly having a generally tubular base connected to said second ground circuit element and projecting from said second circuit board, a generally tubular floating outer contact movable axially and radially relative to said base, portions of said floating outer contact spaced outwardly from said base defining an outside diameter less than said inside diameter of said guide sleeve;

an inner contact assembly disposed within said outer contact assembly and including a receptacle and a plunger movably axially relative to one another, at least one of the plunger and the receptacle being movable radially with the floating outer contact, the inner contact assembly having opposed first and second axial ends;

annular insulators disposed between the inner and outer contact assemblies for maintaining a spaced relationship therebetween; and at least one resilient O-ring between the inner and outer contact assemblies for permitting axial float of the receptacle relative to the plunger of the inner contact assembly while biasing the first and second axial ends of the inner contact assembly against the first and second signal carrying circuit elements.

2. The coaxial connector assembly of claim 1, wherein the guide sleeve has an outwardly tapered entry at an end thereof spaced from said first circuit board, and wherein the floating outer contact of the outer contact assembly includes a chamfered end remote from the second circuit board, the chamfered end of the floating outer contact being engageable with the outwardly tapered entry of the guide sleeve for generating radial float of said floating outer contact relative to said guide sleeve.

3. A coaxial connector comprising:

an outer contact assembly having a generally tubular base and a generally tubular floating outer contact movable axially and radially relative to the base;

an inner contact assembly disposed substantially centrally within the outer contact assembly and including a receptacle and a plunger movable axially relative to one another, at least one of the plunger and the receptacle being movable radially with the floating outer contact;

a plurality of annular insulators disposed between the outer contact assembly and the inner contact assembly for maintaining a spaced relationship therebetween, and at least one resilient O-ring disposed between the inner and outer contact assemblies for permitting axial float of the receptacle relative to the plunger of the inner contact assembly, while biasing the receptacle and the plunger towards an extended position.

4. The coaxial connector of claim 3, wherein the at least one resilient O-ring comprises a plurality of resilient O-rings.

5. The coaxial connector of claim 3, wherein the base of the outer contact assembly includes a plurality of lands for secure connection to conductive regions on a circuit board.

6. The coaxial connector of claim 3, wherein the base of the outer contact assembly further includes a plurality of pins for passing through holes in a circuit board.

7. The coaxial connector of claim 3, wherein the plunger of the inner contact assembly includes a substantially planar mounting end, and wherein the receptacle of the inner contact assembly includes a substantially planar mounting end aligned substantially parallel to the mounting end of the plunger.

8. The coaxial connector of claim 3, further comprising biasing means between the base and the floating outer contact of the outer contact assembly for biasing the floating outer contact into an extended position relative to the base thereof.

9. The coaxial connector of claim 8, wherein the biasing means comprises a spring washer.

* * * * *